United States Patent [19]

Perry

[11] Patent Number: 4,853,985

[45] Date of Patent: Aug. 8, 1989

[54] COVER FOR A HOT TUB OR THE LIKE

[76] Inventor: Cliff R. Perry, 934 S. 259th Pl., Federal Way, Wash. 98003

[21] Appl. No.: 175,746

[22] Filed: Mar. 31, 1988

[51] Int. Cl.[4] ..... E05F 1/14; E05D 15/32; B65D 43/16; B65D 43/24

[52] U.S. Cl. ..... 4/498; 4/503; 49/248; 49/386; 16/287; 16/289; 16/291; 180/69.21; 220/331; 220/333; 220/335

[58] Field of Search ..... 4/498, 503, 546, 580; 220/331, 333, 335; 49/246, 248, 386, 236, 339, 345; 296/100, 101; 74/96; 901/48; 16/287, 289, 291; 180/69.21, 69.2

[56] References Cited

U.S. PATENT DOCUMENTS

| | | | |
|---|---|---|---|
| 1,059,221 | 4/1913 | Saylor | 220/333 X |
| 1,489,633 | 4/1924 | Evans, Jr. | 16/370 |
| 1,923,063 | 8/1933 | Bergstrom et al. | 220/333 X |
| 2,531,140 | 11/1950 | Linde | 220/333 X |
| 2,882,004 | 4/1959 | Leishman | 220/333 X |
| 2,912,237 | 11/1959 | Snyder | 49/199 |
| 2,919,675 | 1/1960 | Beachy | 16/287 X |
| 3,494,219 | 2/1970 | Hillhouse | 220/333 X |
| 3,844,615 | 10/1974 | Anderson | 298/10 |
| 4,382,312 | 5/1983 | Liggett et al. | 16/365 |
| 4,566,552 | 1/1986 | Hoffman et al. | 180/69.21 |
| 4,620,829 | 11/1986 | Herve | 414/720 |
| 4,742,598 | 5/1988 | Bruneau | 16/286 |

*Primary Examiner*—Henry J. Recla
*Assistant Examiner*—Robert Fetsuga
*Attorney, Agent, or Firm*—Hughes & Multer

[57] ABSTRACT

A cover assembly for use with a base structure such as a hot tub comprising a cover member mounted for rotational movement to the base structure by mounting arms.

The mounting arms are arranged relative to the cover member so that the cover member travels along a path from a covering positioning to an open position, this path having a first path portion extending between the covering position and an intermediate location area of the cover member, and a second path portion extending between the open position and the intermediate location area.

The cover member is arranged relative to the mounting arms in a manner that with the cover member on a first side of the intermediate location area in the first path portion, gravitational force on the cover assembly tends to move the cover member to the covering position, and with the cover member on the second side of the intermediate location area in the second path portion, gravitational force on the cover assembly tends to move the cover member to the open position.

There are springs operatively connected to the cover assembly in a manner that with the cover member in either the first path portion or the second path portion, the springs urge the cover member toward the intermediate location area so as to oppose the gravitational force on the cover member and thus permit the cover member to be more easily moved between covering and open positions.

29 Claims, 4 Drawing Sheets

COVER FOR A HOT TUB OR THE LIKE

BACKGROUND OF THE INVENTION

1. Field of the Invention

The present invention relates generally to a cover member and, in particular, to a hard cover for a pool, hot tub or the like which allows a heavy hard cover to be lifted off the top of a pool, hot tub or the like with very little effort, and to be moved to a convenient open position.

2. Background Art

With the increased use of home pools and hot tubs, there has arisen the problem of covering the pool or hot tub when it is not in use. Pool covers generally take the form of a soft cover or sheet type member positioned over the pool, or a solid "styrofoam" type floatable block member. These arrangements have disadvantages in that they are often difficult or combersome to remove and there is heat lost through the covers. In some respects, a preferable cover is in the form of a hard cover positioned entirely over the top of the pool or hot tub. However, the prior art arrangements known to the applicant have been lacking with regard to convenience of moving the cover between its closed and open positions, and also arranging the cover so that it occupies very little space in any position it assumes in moving between its closed and open positions.

A search of the U.S. patent literature has disclosed a number of prior art patents, these being as follows:

U.S. Pat. No. 4,382,312—Liggett et al shows an automobile hood hinge system that pivots the hood to the rear and holds it open at various intermediate position. When an auxiliary hinge member is released from an upper hinge bracket, the hood can be moved to various further open positions.

U.S. Pat. No. 3,844,615—Anderson shows a dumping box with a cover. The cover is positioned by a pair of pivotally mounted links. The linkage uses a hydraulic cylinder to be used to remove the cover, with the hydraulic cylinder acting through a pivoting member 40 to move the link 33.

U.S. Pat. No. 3,494,219—Hillhouse, shows a container lid which is supported in its open position by a linkage system actuated by a hydraulic cylinder. The cover is opened to a position above the container. One link is in the form of a bellcrank 34. The second link 31 is pivotally connected at a level above the lid in its closed position.

U.S. Pat. No. 2,912,237—Snyder shows a side opening door, which is supported by two pivotally mounted links. There is an additional link, connected to a motor which opens the door and rotates the door as it moves to its open position. A spring 84 prevents the crank arm 66 from from stoping at a dead center location.

U.S. Pat. No. 2,882,004—Leishman discloses a linkage system for an x-ray film holder. The linkage allows the device to rotate on two axes because of added linkage elements.

U.S. Pat. No. 2,531,140—Linde shows a trailer cover that is mounted on a spring loaded parallel linkage. The links are arranged so that the cover remains parallel to the lower section of the trailer as it moves between its open and closed position.

U.S. Pat. No. 1,923,063—Bergstron et al shows a cover that rotates on a linkage system so that it moves from the top of the container to a position behind it. There are two pivotally mounted arms which cause the cover to rotate, one of which is pivotally mounted at a back side of the structure and the other at a center location. The cover is arranged so that in its open position, substantaily all of the cover is located below the level of the upper edge of the receptacle wall.

U.S. Pat. No. 1,489,633—Evans shows a cover that rotates on pairs of arms that rotate the door ninety degrees as the door is moved between its open and closed positions.

U.S. Pat. No. 1.059,221—Saylor shows a receptacle cover that is supported by a parallel linkage the cover remains parallel to its closed position when moving to its open position.

SUMMARY OF THE INVENTION

The cover assembly of the present invention is designed to be used with a base structure, and is particularly adapted to be used to cover a container such as a hot tub. The cover assembly is arranged so that it can be easily moved from its cover position through an intermediate location area to a fully open position with relatively small physical effort being required on the part of the person moving the cover assembly.

The assembly comprises a base support structure which in the preferred embodiment may be a hot tub. There is a cover member mounted to the base structure for movement between a first covering position and a second open position. Mounting arm means are provided by which the cover member is mounted for rotational movement between the open and covering positions.

There is mounting arm means arranged relative to the cover member so that the cover member travels along a path from the covering position to the open position, this path having a first path portion extending between the covering position and the intermediate location area of the cover member, and a second path portion extending between the open position and the intermediate location area.

The cover is arranged relative to the mounting arm means in a manner that with the cover member on a first side of the intermediate location area in the first path portion, gravitational force on the cover assembly tends to move the cover member to the covering position, and with the cover member on the second side of the intermediate location area in the second path portion, gravitational force on the cover assembly tends to move the cover member to the open position.

There is spring means operatively connected to the cover assembly in a manner that with the cover member in either the first path portion or the second path portion, the spring means urges the cover member toward the intermediate location area so as to oppose the gravitational force on the cover member and thus permit the cover member to be more easily moved between the covering and open positions.

In the preferred embodiment, the mounting arm means comprises at least one mounting arm connected to the cover member at a connecting location and mounted to the base structure at a pivot mounting location. The spring means acts on the mounting arm at a spring connecting location spaced from the pivot location to exert a first moment on the mounting arm in a first rotational direction when the cover member is in the first path portion, and to exert a second moment on the mounting arm in a second opposite rotational direction when the cover member is in the second path portion.

In one preferred embodiment, the spring means comprises a tension spring means attached between the base structure and the spring connecting location. In this preferred configuration, the mounting arm has an arm extension extending from the first pivot location, and the spring connecting location is on said arm extension. The arm extension extends from the pivot location in a direction generally opposite to the direction in which the mounting arm extends from the pivot location to connect to the cover member. The tension spring means is connected to line means which in turn is connected to the arm extension. The line means extends from the tension spring means to engage at least one pulley and extends from the pulley to contact the arm extension. Thus, a restoring force is exerted from the line means from said arm extension toward the pulley.

In two other embodiments, the spring connecting location is positioned between the first pivot location and the first connecting location. In one embodiment, the spring means comprises first and second tension springs positioned on opposite sides of the connecting means. In another embodiment, the spring means comprises first and second compression springs positioned on opposite sides of the spring connecting location. In the preferred embodiment, the cover assembly is combined with a base structure which is a container having a forward wall, a rear wall and two side walls. The container has an upper edge portion generally aligned in a contact plane having a substantial horizontal alignment component. The cover member overlies the edge portion and is positioned generally in said contact plane when the cover member is in the covering position.

Desirably, the arm means comprises a forward mounting arm having a first end pivotally connected to the container at a first pivot mounting location and a second end pivotally connected to a forward portion of the cover member at a second pivot connecting location. There is a rear mounting arm having a third end pivotally connected to the container at a third pivot mounting location and a fourth end pivotally connected to a rear portion of the cover at a fourth pivot connecting location.

These mounting arms are so arranged that a first distance between the first and second pivot locations is greater than a second distance between the third and fourth pivot locations. The arm means is further characterized in that with the cover memeber in the covering position, the forward arm is aligned at a more moderate forward and upward slope from the first pivot location, and the rear arm is aligned from the third pivot location at a relatively steeper forward and upward slope. The arm means is further characterized in that with the cover member at the open position, the forward arm extends upwardly with the second pivot location being located above the contact plane, with the cover member extending vertically and with at least the forward portion of the cover member being positioned above the contact plane.

With the cover member in the closed position, the arm means has an instantaneous center of rotation which is located, relative to the contact plane, rearwardly of an upper rear edge of the rear wall of the container. Thus, movement of the cover member from the covering position results in a portion of the container adjacent to the upper edge of the rear wall having an initial increment of movement which is rearward and at least moderately upward relative to the upper edge of the rear wall.

The first pivot location is, in the preferred embodiment, located forwardly and below said third pivot location, with reference to the contact plane. Further with the cover member in the covering position, a horizontal distance between the second and fourth pivot locations is greater than a horizontal distance between the first and third pivot locations.

Also, in the present invention, the cover member comprises a relatively rigid main plate member below which is a first insulating layer. A reflective layer is positioned beneath this first insulating layer, and a second insulating layer is positioned between the reflecting layer. There is a moisture impervious lower layer which is beneath the second insulating layer. The main plate member has a peripheral side flange to contain at least the first insulating layer.

Also, in the preferred form, the cover member and the mounting arm means are arranged relative to the spring means so that when the cover is positioned so that when the spring means is positioned so as to exert no moment on the cover member, the center of gravity of the cover member is arranged, relative to the arm means so that gravitational force tends to move the cover member toward the open position.

Other features will become apparent from the following detailed description.

DESCRIPTION OF THE PREFERRED EMBODIMENTS

Figure 1:
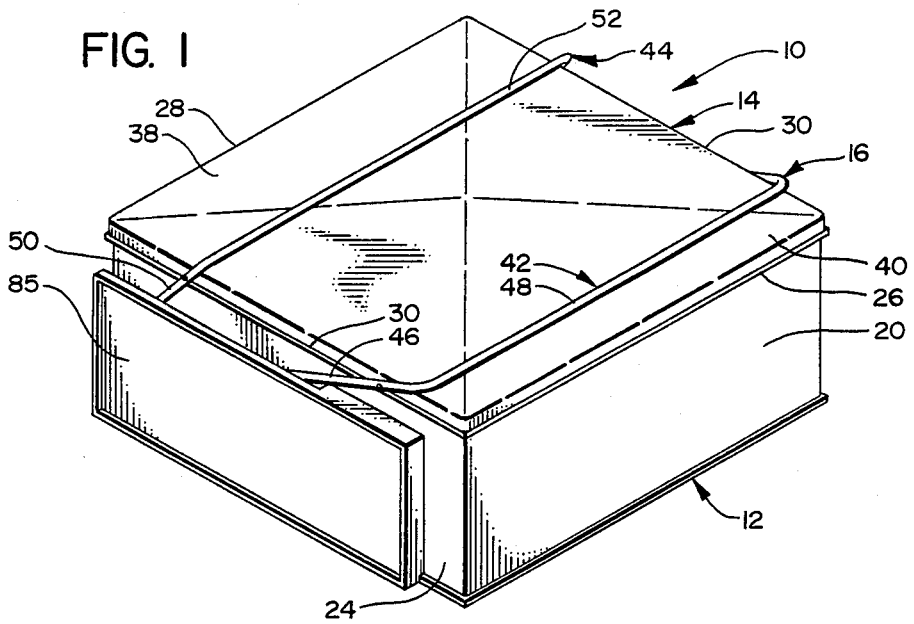
FIG. 1 is an isometric view of the cover assembly of the present invention in its closed position.

The cover assembly 10 of the present invention comprises a base structure 12 which in this embodiment is a hot tub, a cover member 14, a mounting arm means 16, and a spring means 18. The hot tub or base structure 12 is or may be conventional, and as shown herein has front and back walls 20 and 22, respectively, and side walls 24. The cover member 14 as shown herein has a generally planar square configuration with front and rear edge portions 26 and 28, respectively, and side edge portions 30. In the closed position of FIG. 1, the cover member 14 has its front, rear and side edge portions 26 through 30 positioned on top of the upper edge surfaces 32, 34 and 36, respectively, of the front, rear and side walls 20, 22 and 24, respectively.

Figure 2:
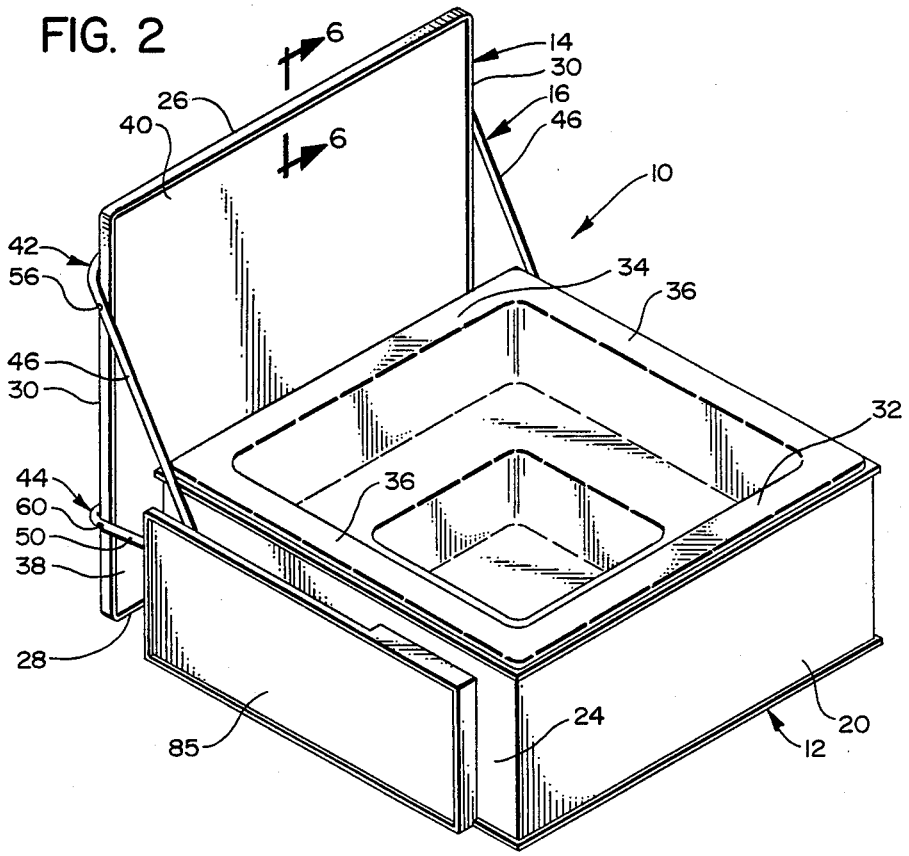
FIG. 2 is an isometric view similar to that of FIG. 1 showing the cover assembly in its open position.
Figure 3:
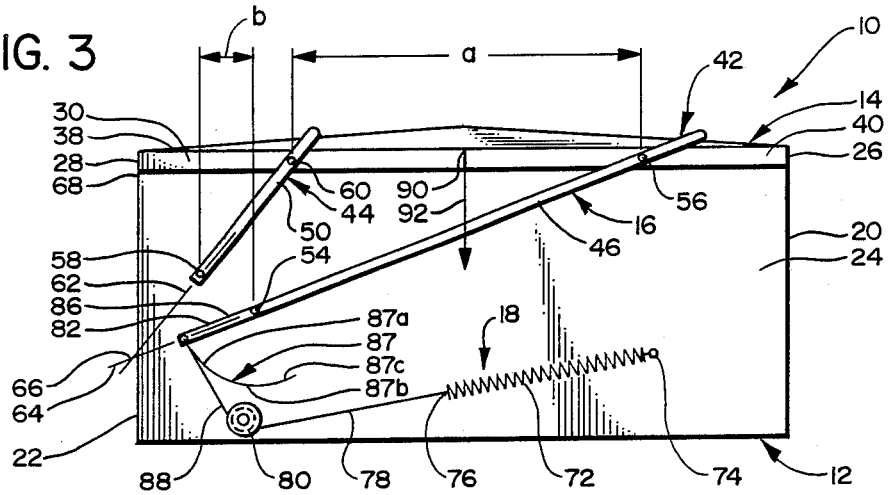
FIG. 3 is a side elevation view of the cover assembly showing the cover member in its horizontally extending covering position.
Figure 5:
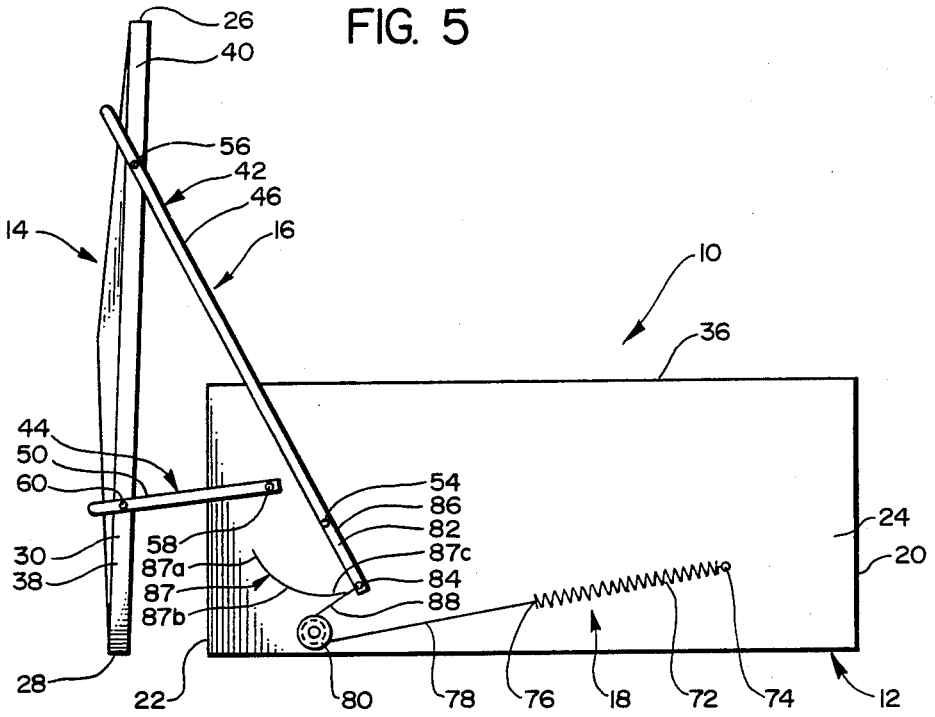
FIG. 5 is a side elevation view of the cover assembly showing the cover member in its fully open position.
Figure 6:
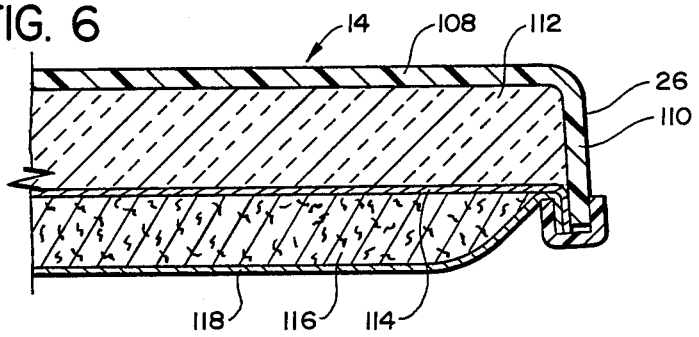
FIG. 6 is a cross sectional view taken through line 6—6 of FIG. 2 of the cover member showing the interior of the cover member.

The cover member 14 is movable from the closed or covering position of FIGS. 1 and 3 along a rearward and rotational path to a fully open position of FIGS. 2 and 5, where the cover member 14 is generally vertically aligned, with a rear cover portion 38 being positioned rearwardly of the rear hot tub wall 22, and a forward cover portion 40 extending upwardly above a plane occupied by the upper edge surface portions 32 through 36 of the hot tub 12.

Figure 4:
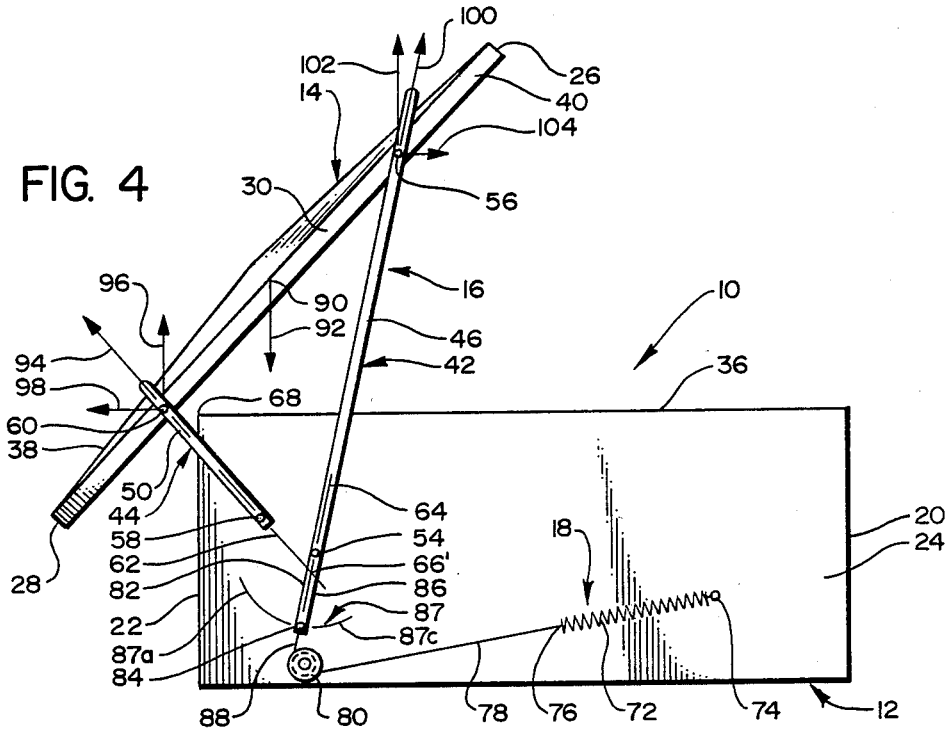
FIG. 4 is a side elevation view of the cover assembly showing the cover member in its intermediate position.

As the cover member 14 moves between its closed position (as shown in FIGS. 1 and 3) to its fully opened position (shown in FIGS. 2 and 5), the cover member 14 passes through an intermediate location area shown in FIG. 4. The cover member 14 is so arranged relative to the arm means 16 that in the closed or covering position, gravitational force urges the cover member 14 to remain in the closed position. The open position, gravitational force urges the cover member 14 to remain in its open position. At a location close to the intermediate location area of FIG. 4, the cover member is closer to being balanced so that the gravitational force which tends to move the cover member 14 toward either its closed or opened position is relatively small. Further, the spring means 18 is arranged so that with the cover member 14 in the intermediate location area of FIG. 4, the spring means 18 is at, or close to, a neutral position where it is urging the cover member 14 to neither its opened or closed positions. However, when the cover member 14 is moved to one side or the other of the intermediate location area of FIG. 4, the spring means 18 urges the cover member 14 back toward the intermediate position of FIG. 4. The net result is that the spring means 18 counteracts to a substantial extent the gravitational force acting on the cover member 14 so that the cover member 14 moves easily between the opened and closed positions with the person having to exert a relatively small force on the cover member 14 to cause such movement.

To describe the mounting arm means 16 more particularly, there is a main forward arm 42 and a second rear arm 44. The forward arm 42 has a generally U-shaped configuration and comprises two side arm sections 46 which are rigidly interconnected at their upper ends by a cross arm section 48. In like manner, the second arm 44 comprises two side arm section 50 which are rigidly interconnected by a cross arm section 52. The lower rear portions of the side arm sections 46 are connected at lower rear pivot locations 54 which are on the same transverse axis. The upper forward portions of the side arms 46 are pivotally connected to the forward portion 40 of the cover member 14 at cover pivot locations 56 which lie on the same transverse axis.

The lower portions of the side arms sections 50 are pivotally connected at pivot locations 58 that are transversely aligned with one another, while the upper portions of the side arm sections 50 are pivotally connected to the rear cover portion 38 at cover pivot locations 60 at the sides of the rear cover portion 38. It will be noted, with reference to FIG. 3, that with the cover member 14 in its closed position, the rear arm 44 is positioned so that its pivot locations 58 and 60 are aligned at an upward and forward slant moderately greater than about 45 degrees to the horizontal, and desirably at a slant between one-half of a right angle to two-thirds of a right angle. Also, with the cover member 14 in its closed position, the forward arm 42 is positioned so that the alignment of its pivot locations 54 and 56 is at an upward and forward slant which is at a lesser angle relative to the horizontal (e.g., between about 10 degrees and 30 degrees, and desirably about 20 degrees). Further, the base pivot location 54 of the forward arm 40 is located forwardly and moderately downwardly from the base pivot location 58 of the rear arm 44. The distance between the cover pivot locations 56 and 58 (this distance being indicated at "a" in FIG. 3) is substantially greater than the horizontal distance between the base pivot locations 54 and 58 (indicated at "b" in FIG. 3).

To discuss another relationship in the positioning of the arms 42 and 44, it will be noted that if an imaginary line 62 is drawn through the pivot locations 58 and 60 of the rear arm 44, and if a second imaginary line 64 is drawn through the pivot locations 54 and 56 of the forward arm 42, the point of intersection 66 of these lines 62 and 64 represents an instantaneous center of rotation of the cover member 14. It will be noted that with the cover member 14 in its closed position, this instantaneous center of rotation 66 is positioned rearwardly of the upper rear edge 68 of the upper edge rear surface 34 of the rear hot tub wall 22. The effect of this is that as the cover member 14 begins to rotate upwardly and rearwardly from its closed position of FIG. 3, the extreme rear edge 28 of the cover member 14 initially moves rearwardly with a slight upward component of movement so that the cover member 14 clears the rear edge 68 of the hot tub back wall 22. Thus, this instantaneous center of rotation 66 should at least be as far rearwardly as the rearmost upper edge 68 adjacent to the cover member 14, and desirably moderately rearwardly thereof when the cover member 14 is in its closed position.

As the cover member 14 continues to move upwardly and rearwardly from its closed position, this instantaneous center of rotation shifts to a more forward location (indicated at 66′ of FIG. 4), the net effect is that the cover member 14 is permitted to move from its closed position to its opened position in a manner that it is not obstructed by the rear hot tub wall 22, and during the latter portion of travel of the cover member 14 to its fully open position, the cover member 14 is positioned only a moderate distance from the rear hot tub wall 22 (see FIG. 5).

To discuss the operation of the spring means 18, in the first embodiment shown herein, this spring means 18 comprises a pair of tension springs 72 positioned adjacent to the hot tub side walls 24. Each tension spring 72 is connected to its related hot tub side wall 24 at a forward spring connecting location 74, and the opposite end 76 of each spring 72 is connected to a cord or line 78. This cord or line 78 extends around a related pulley 80 to connect to a lower rear end 86 of its related side arms section 46 at a connecting location 84. In the end configuration each spring means 18 is enclosed by a side plate 85 (see FIGS. 1 and 2), but in FIGS. 3 through 5, the side plate 85 has been removed for purposed of illustration.

It will be noted that the connecting point 84 of the cord 78 is spaced from the base pivot location 54 of the side arm sections 46 so that each side arm section 46 in effect has an arm extension 86 extending beyond the pivot location 54 to the connecting location 84.

It will be further noted that the cord connecting location 84 travels an arcuate path 87. This arcuate path 87 has a first path portion **87*a* which extends from the location shown in FIG. 3 to the location shown in FIG. 4 where this path 87 comes closest to the location where the cord 78 engages the pulleys 80 in a manner that the extreme end portion 88 of the cord 78 is aligned with the two pivot locations 54 and the point of engagement with the pulley 80. The location of the connecting point 84 at the position of FIG. 4 on the path 87 is indicated at 87***b*. Then there is a path portion 87*c* which extends from the location of FIG. 4 to the fully opened position of FIG. 5.

To discuss now the operation of the spring means 18, it can be seen from examining FIG. 3 that the cord 78 is under tension and is acting at the point 84 to tend to rotate the forward arm 42 upwardly and rearwardly in a counter-clockwise direction. As the cover member 14 moves upwardly toward the intermediate location area of FIG. 4, the connecting location 84 of the arm side sections 46 moves on the path 87 more closely to the pulley 80 so that the related tension spring 72 contracts and thus exerts a somewhat smaller force on the cord 78. Further, at the location of FIG. 4, since the tension force exerted by the cord end portion 88 is directly aligned with the pivot location 54, the cord 78 at the position of FIG. 4 is exerting no moment at all on the forward arm 42. However, as the cover member 14 rotates further toward the position of FIG. 5, it can be seen that the connecting location 84 begins to move forwardly further away from the pulley 80, thus stretching the tension spring 72 further. Further, the alignment of the end portion 88 of the cord 78 moves further out of alignment with the forward arm pivot location 54 so that the effective moment arm along which the cord portion 88 acts increases in length. Thus, both the tension force exerted by the spring 72 on the cord 78 and the moment arm increase to thus effectively increase the restoring force which would tend to move the cover member 14 from the fully open position of FIG. 5 to the intermediate location area of FIG. 4. The same is true when the cover member is in the closed position of FIGS. 1 and 3. It can be seen from examining FIG. 3 that the cord end portion 88 is positioned so as to stretch the tension spring 72, and the alignment of this cord end portion 88 is such that the moment arm along which the cord portion 88 acts is close to a maximum.

Let us now examine further the manner in which gravity acts on the cover member 14. With the cover member 14 being symmetrically shaped, we can assume that the net gravitational force acts through a center of gravity 90 of the cover member 14, with this center of gravity 90 being located midway between the forward and rear edges of the cover member 14. There is a downward gravitational force 92 exerted from the location of the center of gravity 90, and this is counteracted at the two cover pivot locations 56 and 60. At the rear pivot cover location 60, the force 94 is exerted on the cover member 14 in a direction which is aligned with the pivot locations 58 and 60. This force 94 can be divided into a vertical force component 96 and a horizontal force component 98.

In like manner, there is exerted at the forward cover pivot location 56 a force 100 which is aligned with the pivot locations 54 and 56. This force 100 can in turn be divided into a vertical force component 102 and a lateral force component 104.

The two vertical force components 96 and 102 would, presuming the cover 14 is balanced at a stationary position, be equal to the downward force 92 exerted by gravity on the cover member 14. In the particular arrangement shown herein, the rear arm 44 in the position of FIG. 4 is at a slant such that its horizontal force component 98 is greater than the horizontal force component 104 exerted by the forward arm 42. Thus, in the particular arrangement shown herein, in the position of FIG. 4 the net effect is that the cover 14 is being urged by gravity from the intermediate position toward the fully open position of FIG. 5. However, as the cover 14 moves further rearwardly from the position of FIG. 4, the spring means 18 begins to exert an increasing restoring force tending to counteract the effect of the gravitational force. In this particular embodiment, the mounting arms 42 and 44, the spring means 18 and the cover 14 are arranged so that only a moderate lifting force is required to lift the cover 14 from the closed position of FIG. 3 and initiate movement of the cover member toward the intermediate location area of FIG. 4. The effect of the action of the spring means 18 and the gravitational force 92 is such that the cover 14 is, without further manual force being exerted thereon, moved through the intermediate position of FIG. 4 and toward the open position of FIG. 5. However, as the cover member 14 approaches the position of FIG. 5, the spring means 18 resists the effect of the gravitational force to cause the cover member 14 to move more gently toward the fully open position.

It should also be recognized that as the cover member 14 moves to a more extreme forward position or a more extreme rear position, the location of the center of gravity 90 moves further forward or further rearward, respectively, so as to effectively increase the moment arm about which the gravitational force is exerted, relative to the base pivot locations 54 and 58, so that the net effect of the gravitational force on the cover member is greater.

From an examination of FIGS. 3 through 5, it is readily apparent that these various operating components can be arranged in various fashions to modify the action of the spring means 18 relative to the gravitational force. For example, it can be seen that if the pulley 80 is moved further rearwardly, the equilibrium point 86*c* on the path 86 will be moved further rearwardly so that the moment arm of the cord end portion 88 is at its null position when the cover 14 is at a further forward position, where the lateral force component 98 exerted at the cover pivot location 60 would be decreased to some extent, while the lateral force component 104 exerted at the cover pivot location 56 would be increased, and where the location of the center of gravity 90 relative to the base pivot locations 54 and 58 would be moved further forwardly. This would influence the precise position of the cover member 14 where it would be at a totally balanced position at which the force exerted by the spring means and by gravity would cancel each other out and the cover member 14 would tend to remain at a stable intermediate position.

Further, the tension spring 72 could be replaced with a stronger or weaker tension spring, or the connecting location of the tension spring 72 could be modified to increase the tension force of the spring 72. Also, it is to be understood that the above discussion is somewhat idealized in that the weight of the forward and rear arms 42 and 44 has been ignored in this analysis.

It is to be recognized from the above discussion that the precise location of this intermediate location area can be varied to some extent. In general, this intermediate location can be considered an area, which is proximate to the location at which the moments exerted by the gravitational force and the force of the spring means 18 nearly cancel each other out (or where the moments are both zero). Thus, in FIG. 4 the cover member 14 is at the rear part of the intermediate location area.

To review then the overall function of the present invention, let it be assumed that the cover member 14 is at the closed position of 1 and 3. In this position, the center of gravity 90 of the cover member 14 is sufficiently far forward of the rear base pivot locations 54 and 58 so that the force of gravity (indicated at 92) causes the cover member 14 to remain closed. In the closed position, however, the moment exerted by the spring means 18 is at its maximum relative to the first path of travel of the cover member 14 between the closed position of FIG. 3 to the intermediate location area of FIG. 4. The spring means 18 is arranged relative to the other components so that only a moderate lifting force need be exerted at the front edge of the cover 14 to lift the cover 14 upwardly. As the cover 14 moves upwardly and rearwardly, the center of gravity 90 moves further toward a rearward position, and the instantaneous center of rotation 66 tends to move downwardly and to a more forward position. In the particular arrangement shown herein, the cover member 14 passes into the intermediate location area at a location moderately forward of the position of FIG. 4 where the gravitational force, indicated at 92, exerts no moment on the lid 14 to urge the cover member 14 to either the closed or opened position. However, since this position would be moderately forwardly of the position of FIG. 4, the cord 78 would still be exerting a counter-clockwise moment on the cover 14 so as to tend to move it further rearwardly.

Thus, without any further exterior force being exerted on the cover 14, this cover 14 moves to the position of FIG. 4, and actually continues through this position since the gravitational force, indicated at 92, exerts a moment on the cover member 14 to cause further counter-clockwise rotation thereof. Thereafter, the tension exerted by the spring 72 on the cord 78 resists the gravitational force, this being accomplished in a manner that there is a relatively small net counter-clockwise moment exerted on the cover member 14 to cause it to continue on its downward and rearward movement. When the cover member 14 reaches its end limit of travel to be at the fully opened position of FIG. 5, the gravitational force 92 exerts a sufficient moment on the cover member 14 to fully counteract the moment exerted by the spring means 18 so that the cover member 14 remains in its open position.

To move the cover member 14 to the closed position, the person simply exerts a moderate lifting force on the cover member 14 to rotate the cover member 14 counter-clockwise through the intermediate position area and down to the closed position of FIG. 3.

With regard to the structure of the cover member 14, there is a relatively rigid plastic top wall 108 having downwardly extending side flanges 110 made integral therewith. This top wall 108 and the flanges 110 can be made from materials such as a resin or thermal-plastic material which is ultraviolet and high temperature resistant. Positioned immediately beneath the top wall 108 is a layer of rigid foam 112, below which is positioned a layer of aluminum foil 114 impregnated with glass thread or the like to provide a vapor barrier for the foam 112. This aluminum foil layer 114, in addition to provide a water vapor barrier, tends to reflect radiant heat from the water inside the hot tub 12.

Figure 7:
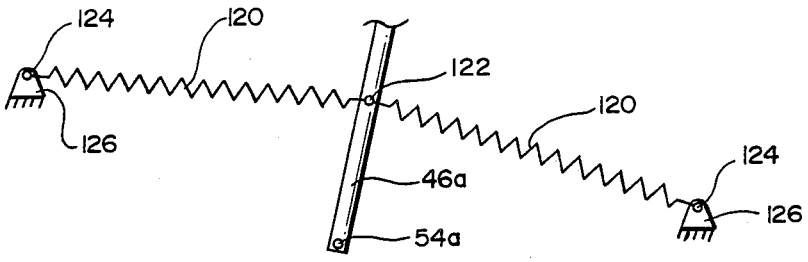
FIG. 7 is a schematic view showing a second embodiment of the spring means incorporated in the present invention.

Positioned beneath the aluminum foil layer 114, there is a thermal blanket 116 of "Hollowfil" (a trademark) or a similar insulating material. Beneath this "Hollowfil" layer, there is a lowermost sheet of an abrasion and puncture resistant water impervious material 118 which is impregnated with an anti-fungal material to prevent mildew. FIG. 7 shows a further embodiment of the spring means incorporated in the present invention. The side arm section of the forward arm is shown at **46*a*, and only a portion of this side arm is shown. The extension portion 86 is eliminated, and the pivot location 54*a* is at the extreme lower end of the side arm section 46*a* which is shown positioned at the intermediate location area. There are two tension springs 120 connected to the arm section 46*a* at a location 122 positioned between the pivot location 54*a* and the location of the pivot connection to the cover member 14. The opposite ends of the tension springs 120 are connected at 124 to stationary structure (i.e., the side wall 24), which is indicated schematically at 126**.

Figure 8:
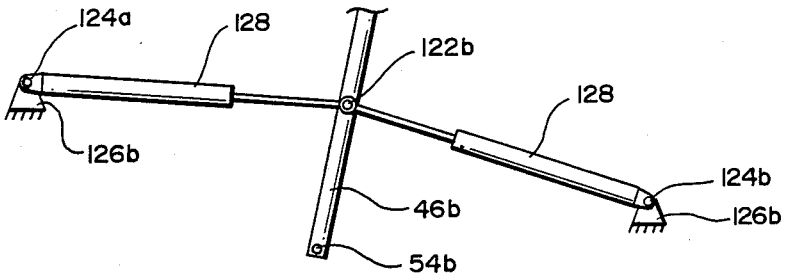
FIG. 8 is a schematic view showing a third embodiment of the spring means incorporated in the present invention.

A third embodiment of the spring means is shown in FIG. 8, and this embodiment is substantially the same as the embodiment of FIG. 7, except that air springs have been substituted for the tension springs 120. Thus, there is the arm **46*b* pivotally mounted at 54*b* with two air springs 128 connected to the arm 46*b* at a location 122*b*. The other ends of the air springs 128 are connected at 124*b* to stationary structure 126*b*. In this particular embodiment, these air springs 128** are compression springs.

The mode of operation of the further embodiments shown in FIGS. 7 and 8 are substantially the same as in the first embodiment in terms of the net effect achieved. In both instances, the springs 120 and 128 urge the side arm section **46*a* or 46*b*** toward an intermediate position. It is to be understood that various spring combinations or arrangements could be used.

Also, it is to be recognized that various modifications could be made to the cover assembly of the present invention without departing from the basic teachings thereof.

What is claimed is:

1. A cover assembly for a base structure such as a hot tub, the cover assembly having a forward end and rear end, the cover assembly comprising:

a. a base support structure;

b. a cover member mounted to the base structure for movement between a first covering position and a second open position;

c. mounting arm means by which said cover member is mounted for rotational movement between said open and covering positions;

d. said mounting arm means being arranged relative to the cover member so that the cover member travels along a path from the covering position to the open position, said path having a first path portion extending between said covering position and an intermediate location area of said cover member, and a second path portion extending between the open position and the intermediate location area;

e. the cover member being arranged relative to the mounting arm means in a manner that with the cover member on a first side of the intermediate location area in the first path portion, gravitational force on the cover assembly tends to move the cover member to the covering position and with the cover member on a second side of the intermediate location area in the second path portion, gravitational force on the cover assembly tends to move the cover member to the open position;

f. spring means operatively connected in the cover assembly in a manner that with the cover member in either the first path portion or the second path portion, said spring means urges the cover member toward the intermediate location area so as to oppose the gravitational force on the cover member and thus permit the cover member to be more easily moved between the covering and open positions; and g. Said mounting arm means comprising at least one movable mounting arm connected to the cover member at a first connecting location and mounted to the base structure at a first pivot location, said spring means acting on said movable mounting arm at a spring connecting location spaced from said pivot location to exert a first moment on said movable mounting arm in a first rotational direction when said cover member is in said first path portion, and to exert a second moment on said movable mounting arm in a second opposite rotational direction when said cover member is in said second path portion.

2. The cover assembly as recited in claim 1, wherein said spring means comprises a tension spring means attached between said base structure and said spring connecting location.

3. The cover assembly as recited in claim 2, wherein said movable mounting arm has an arm extension extending from said first pivot location, and said spring connecting location is on said arm extension.

4. The cover assembly as recited in claim 3, wherein said arm extension extends from said pivot location in a direction generally opposite to a direction in which said movable mounting arm extends from said pivot location to connect to said cover member.

5. The cover assembly as recited in claim 4, wherein said tension spring means is connected to line means, which is in turn connected to said arm extension.

6. The cover assembly as recited in claim 5, wherein said line means extends from said tension spring means to engage at least one pulley and extends from said pulley to connect to said arm extension, whereby a restoring force is exerted from said line means from said arm extension toward said pulley.

7. The cover assembly as recited in claim 1, wherein said spring connecting location is positioned between said first pivot location and said first connecting location.

8. The cover assembly as recited in claim 7, wherein said spring means comprises first and second tension means positioned on opposite sides of said connecting location.

9. The cover assembly as recited in claim 7, wherein said spring means comprises first and second compression springs positioned on opposite sides of said spring connecting location.

10. A cover assembly for a base structure such as a hot tub, the cover assembly having a forward end and rear end, the cover assembly comprising:

a. a base support structure;

b. a cover member mounted to the base structure for movement between a first covering position and a second open position;

c. mounting arm means by which said cover member is mounted for rotational movement between said open and covering positions;

d. said mounting arm means being arranged relative to the cover member so that the cover member travels along a path from the covering position to the open position, said path having a first path portion extending between said covering position and an intermediate location are of said cover member, and a second path portion extending between the open position and the intermediate location area;

e. the cover member being arranged relative to the mounting arm means in a manner that with the cover member on a first side of the intermediate location area in the first path portion, gravitational force on the cover assembly tends to move the cover member to the covering position, and with the cover member on a second side of the intermediate location area in the second path portion, gravitational force on the cover assembly tends to move the cover member to the open position;

f. spring means operatively connected in the cover assembly in a manner that with the cover member in either the first path portion or the second path portion, said spring means urges the cover member toward the intermediate location area so as to oppose the gravitational force on the cover member and thus permit the cover member to be more easily moved between the covering and open positions;

g. said base structure being a container having a forward wall, a rear wall and two side walls, said container having an upper edge portion generally aligned in a contact plane having a substantial horizontal alignment component, said cover member overlying said edge portion and being positioned generally in said contact plane when said cover member is in the covering position;

h. said arm means comprising:

i. a forward mounting arm having a first end pivotally connected to said container at a first pivot mounting location and a second end pivotally connected to a forward portion of said cover member at a second pivot connecting location, ii. a rear mounting arm having a third end pivotally connected to said container at a third pivot mounting location and a fourth end pivotally connected to a rear portion of said cover at a fourth pivot connecting location; and iii. a first distance between said first and second pivot locations being greater than a second distance between said third and fourth pivot locations, said arm means being further characterized in that with the cover member in the covering position, said forward arm is aligned at a more moderate forward and upward slope from said first pivot location, and said rear arm is aligned from said third pivot location at a relatively steeper forward and upward slope, said arm means being further characterized in that with the cover member at the open position, the forward arm extends upwardly with the second pivot location being located above the contact plane, with the cover member extending vertically and with at least the forward portion of the cover member being positioned above said contact plane.

11. The cover assembly as recited in claim 10, wherein with the cover member in the closed position, said arm means has an instantaneous center of rotation which is located, relative to said contact plane, rearwardly of an upper rear edge of the rear wall of the container, whereby movement of said cover member from the covering position results in a portion of said container adjacent to the upper edge of the rear wall having an initial increment of movement which is rearward and at least moderately upward relative to the upper edge of the rear wall.

12. The cover assembly as recited in claim 11, wherein the first pivot location is located forwardly and below said third pivot location, with reference to said contact plane, and with the cover member in the covering position, a horizontal distance between the second and fourth pivot locations is greater than a horizontal distance between the first and third pivot locations.

13. The cover assembly as recited in claim 10, wherein the first pivot location is located forwardly and below said third pivot location, with reference to said contact plane, and with the cover member in the covering position, a horizontal distance between the second and fourth pivot locations is greater than a horizontal distance between the first and third pivot locations.

14. The cover assembly as recited in claim 1, wherein:

a. said arm means comprises:

i. a forward mounting arm having a first end pivotally connected to said base support structure at a first pivot mounting location and a second end pivotally connected to a forward portion of said cover member at a second pivot connecting location, ii. a rear mounting arm having a third end pivotally connected to said container at a third pivot mounting location and a fourth end pivotally connected to a rear portion of said cover at a fourth pivot connecting location;

b. said spring means acts on one of said forward and rear mounting arms at a spring connecting location spaced from the pivot location of said one of said forward and rear mounting arms to exert a first moment on said one of said forward and rear mounting arms in a first rotational direction when said cover member is in said first path portion, and to exert a second moment on said one of said forward and rear mounting arms in a second opposite direction when said cover member is in said second path portion; and c. said one of said forward and rear mounting arms being said movable mounting arm.

15. The cover assembly as recited in claim 14, wherein said spring means comprises a tension spring means attached between said base structure and said spring connecting location.

16. The cover assembly as recited in claim 15, wherein said one of said mounting arms has an arm extension extending from the pivot location of said one of said mounting arms, and said spring connecting location is on said arm extension.

17. The cover assembly as recited in claim 16, wherein said arm extension extends from the pivot location of said one of said mounting arms in a direction generally opposite to a direction in which said one of said mounting arms extends from the pivot mounting location of said one of said mounting arms to the pivot connecting location of said one of said mounting arms.

18. The cover assembly as recited in claim 17, wherein said tension spring means is connected to line means, which is in turn connected to said arm extension.

19. The cover assembly as recited in claim 18, wherein said line means extends from said tension spring means to engage at least one pulley and extends from said pulley to connect to said arm extension, whereby a restoring force is exerted from said line means from said arm extension toward said pulley.

20. The cover assembly as recited in claim 14, wherein said spring connecting location is positioned between the pivot mounting location and the pivot connecting location of said one of said mounting arms.

21. The cover assembly as recited in claim 20, wherein said spring means comprises first and second tension means positioned on opposite sides of said spring connecting location.

22. The cover assembly as recited in claim 20, wherein said spring means comprises first and second compression springs positioned on opposite sides of said spring connecting location.

23. The cover assembly as recited in claim 14, wherein a. said base structure is a container having a forward wall, a rear wall and two side walls, said container having an upper edge portion generally aligned in a contact plane having a substantial horizontal alignment component, said cover member overlying said edge portion and being positioned generally in said contact plane when said cover member is in the covering position;

b. first distance between said first and second pivot locations is greater than a second distance between said third and fourth pivot locations, said arm means being further characterized in that with the cover member in the covering position, said forward arm is aligned at a more moderate forward and upward slope from said first pivot location, and said rear arm is aligned from said third pivot location at a relatively steeper forward and upward slope, said arm means being further characterized in that with the cover member at the open position, the forward arm extends upwardly with the second pivot location being located above the contact plane, with the cover member extending vertically and with at least the forward portion of the cover member being positioned above said contact plane.

24. The assembly as recited in claim 23, wherein with the cover member in the closed position, said arm means has an instantaneous center of rotation which is located, relative to said contact plane, rearwardly of an upper rear edge of the rear wall of the container, whereby movement of said cover member from the covering position results in a portion of said container adjacent to the upper edge of the rear wall having an initial increment of movement which is rearward and at least moderately upward relative to the upper edge of the rear wall.

25. The cover assembly as recited in claim 24, wherein said instantaneous center of rotation moves in a forward direction as said cover member moves toward said open position, and said instantaneous center of rotation is forward of the upper rear edge of the rear wall of the container when the cover member is in the intermediate location area.

26. The cover assembly as recited in claim 25, wherein the first pivot location is located forwardly and below said third pivot location, with reference to said contact plane, and with the cover member in the covering position, a horizontal distance between the second and fourth pivot locations is greater than a horizontal distance between the first and third pivot locations.

27. The cover assembly as recited in claim 23, wherein the first pivot location is located forwardly and below said third pivot location, with reference to said contact plane, and with the cover member in the covering position, a horizontal distance between the second and fourth pivot locations is greater than a horizontal distance between the first and third pivot locations.

28. The cover assembly as recited in claim 1, wherein said cover member comprises:

a. an upper substantially rigid main plate member;

b. first insulating layer positioned below said main plate member;

c. a radiant heat reflecting member positioned below said first insulation layer;

d. a second insulating layer positioned below said radiant heat reflecting layer; and e. a moisture resistant layer positioned below said second insulating layer.

29. The cover assembly as recited in claim 28, wherein said main plate member has a depending peripheral flange, and said first insulating layer is positioned within said depending peripheral flange.

* * * * *